US008366499B2

(12) United States Patent
Shuey et al.

(10) Patent No.: US 8,366,499 B2
(45) Date of Patent: Feb. 5, 2013

(54) GROUND TERMINAL ASSEMBLY FOR A VEHICLE

(75) Inventors: John Raymond Shuey, Mechanicsburg, PA (US); John Mark Myer, Millersville, PA (US); Forrest Irving Kinsey, Jr., Harrisburg, PA (US); Douglas John Hardy, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 48 days.

(21) Appl. No.: 13/114,758

(22) Filed: May 24, 2011

(65) Prior Publication Data

US 2012/0302089 A1 Nov. 29, 2012

(51) Int. Cl.
*H01R 11/11* (2006.01)

(52) U.S. Cl. ..... 439/883

(58) Field of Classification Search ..... 439/883, 439/889, 108, 287, 288
See application file for complete search history.

(56) References Cited

U.S. PATENT DOCUMENTS 4,371,230 A * 2/1983 Inoue ..... 439/849
5,688,131 A * 11/1997 Byfield, Jr. ..... 439/92

* cited by examiner

*Primary Examiner* — Tulsidas C Patel
*Assistant Examiner* — Phuongchi Nguyen

(57) ABSTRACT

A ground terminal is provided for a vehicle. The ground terminal includes a hub having an opening extending therethrough. The opening is configured to receive a fastener for attaching the hub to the vehicle. A plurality of electrical contacts extend radially outward from the hub. Each electrical contact extends outwardly from the hub to a free end portion. The free end portions of the electrical contacts are arranged in an arcuate pattern.

19 Claims, 9 Drawing Sheets

GROUND TERMINAL ASSEMBLY FOR A VEHICLE

BACKGROUND OF THE INVENTION

The subject matter described and/or illustrated herein relates generally to electrical ground terminals, and more particularly, to a ground terminal assembly for use with a vehicle.

Modern vehicles are equipped with a wide variety of electrical components. For example, automobiles include electrical components that facilitate operation of the automobile, such as headlights and fuel injection components, along with auxiliary electrical components such as radios and power windows. Such electrical components are electrically connected to an electrical power source of the vehicle, for example a battery, via electrical wiring. Electrical wiring also grounds each electrical component to the vehicle. Specifically, each electrical component is electrically connected to a ground terminal via one or more electrical wires. The ground terminal is mounted on a ground point of the vehicle such that electrical connection between the electrical wire(s) and the ground terminal grounds the electrical component to the vehicle. For example, some electrical components of automobiles are electrically connected to ground points located within the engine compartment of the automobile.

Currently, at least some known ground terminals are capable of connecting only a limited number of electrical wires to the corresponding ground point. Specifically, at least some known ground terminals only include two electrical contacts such that the ground terminal can only connect to two electrical wires. Accordingly, at least some known ground terminals are only capable of grounding a limited number of different electrical components to a common ground point. As the number of electrical components of modern vehicles increases, the number of ground points and ground terminals therefore also increases, which may increase a cost and/or a difficulty of assembling the vehicle.

There is a need for a ground terminal for a vehicle that is capable of grounding an increased number of electrical components to a common ground point of the vehicle as compared with at least some known ground terminals.

BRIEF DESCRIPTION OF THE INVENTION

In one embodiment, a ground terminal is provided for a vehicle. The ground terminal includes a hub having an opening extending therethrough. The opening is configured to receive a fastener for attaching the hub to the vehicle. A plurality of electrical contacts extend radially outward from the hub. Each electrical contact extends outwardly from the hub to a free end portion. The free end portions of the electrical contacts are arranged in an arcuate pattern.

Optionally, at least one of the electrical contacts comprises a tab configured to be received within a receptacle of a ground wire terminal for electrical connection to the ground wire terminal. In some embodiments, the hub includes a central axis and the free end portions of each of the electrical contacts optionally extend radially outward from the hub approximately the same distance from the central axis as each other. In some embodiments, the electrical contacts optionally extend radially outward relative to the central axis. Optionally, a flange extends outwardly from the hub, wherein the flange is configured to engage a portion of the vehicle for attaching the hub to the vehicle.

A ground wire terminal may be engaged with an electrical contact of the plurality of electrical contacts. Optionally, the ground wire terminal includes an opening extending therethrough, wherein the ground wire terminal is engaged with the electrical contact such that the opening of the ground wire terminal is at least partially aligned with the opening of the hub. Optionally, the ground wire terminal includes a wire engagement portion configured to be electrically connected to a ground wire.

In another embodiment, a ground terminal assembly is provided for a vehicle. The ground terminal assembly includes a base hub. The base hub includes a base opening extending therethrough. The base opening is configured to receive a fastener for attaching the base hub to the vehicle. A plurality of base electrical contacts extend radially outward from the base hub. The ground terminal assembly also includes an extender hub having an extender opening extending therethrough. The extender opening being is to receive the fastener for attaching the extender hub to the vehicle. A plurality of extender electrical contacts extend radially outward from the extender hub. The extender hub is configured to be stacked on the base hub such that the extender opening is at least partially aligned with the base opening.

DETAILED DESCRIPTION OF THE INVENTION

Figure 1:
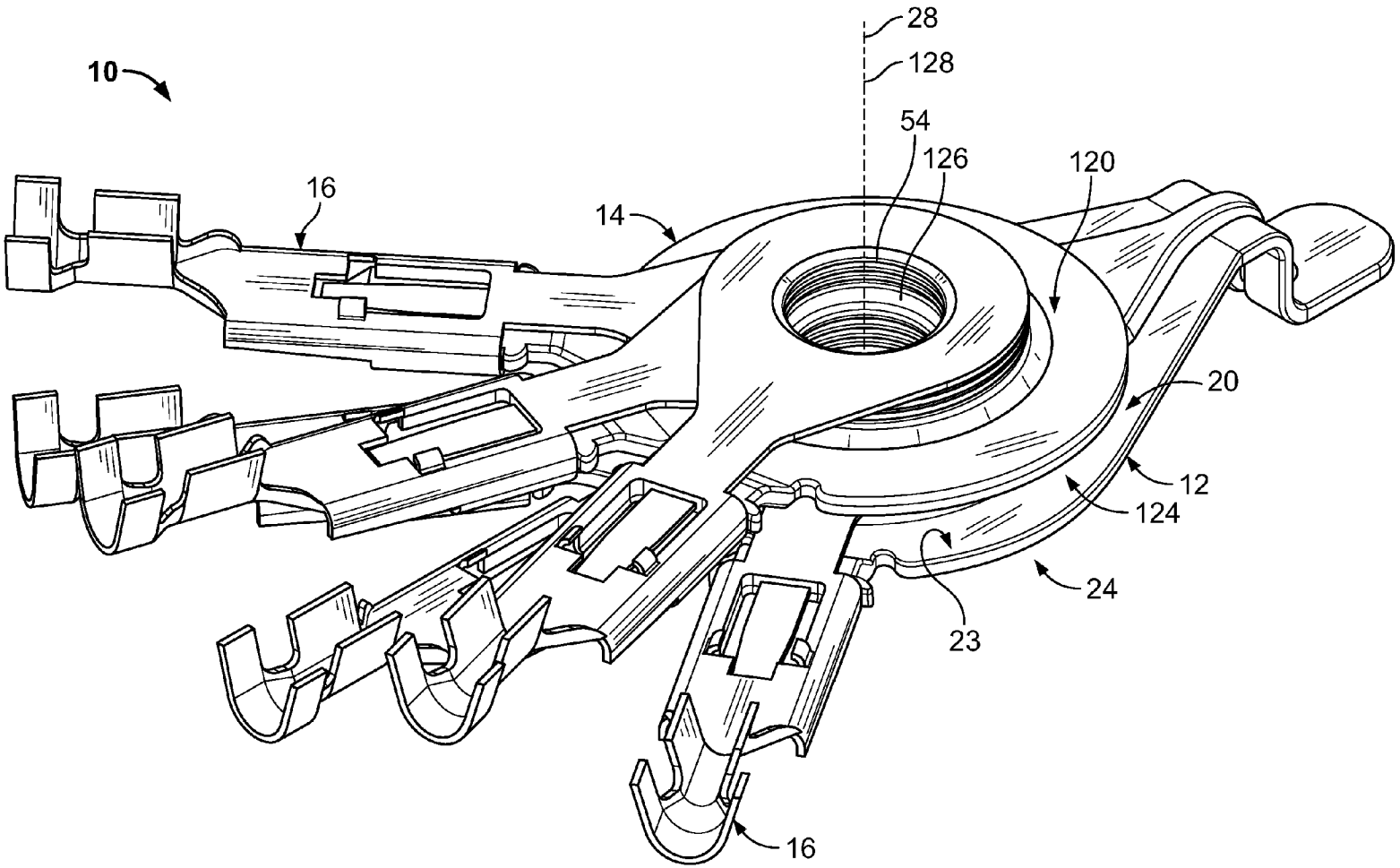
FIG. 1 is a perspective view of an exemplary embodiment of a ground terminal assembly.

FIG. 1 is a perspective view of an exemplary embodiment of a ground terminal assembly 10. The ground terminal assembly 10 includes a base ground terminal 12, an extender ground terminal 14, and a plurality of ground wire terminals 16 extending from each of the base ground terminal 12 and the extender ground terminal 14. The base ground terminal 12 and the extender ground terminal 14 may each be referred to herein as a "ground terminal". As will be described below, the base ground terminal 12 and the extender ground terminal 14 are configured to be mounted on a ground point (not shown) of a vehicle (not shown) for grounding a plurality of electrical components (not shown) of the vehicle to the vehicle. Specifically, and as will be described below, each of the ground wire terminals 16 is configured to be engaged with, and thereby electrically connected to, an electrical wire (not shown) that is electrically connected to one of the electrical components. Via engagement with the ground point, the base ground terminal 12 and the extender ground terminal 14 electrically connect each electrical wire to the ground point, and thereby electrically connect each electrical component to the ground point. Each electrical wire may be referred to herein as a "ground wire".

As can be seen in FIG. 1 and will be described below, the base ground terminal 12 and the extender ground terminal 14 each electrically connect a plurality of the ground wire terminals 16 to the common ground point that the base ground terminal 12 and the extender ground terminal 14 are mounted on. Accordingly, each terminal 14 and 16 electrically connects a plurality of electrical components to the common ground point. Although the ground terminal assembly 10 is shown as having only one extender ground terminal 14 stacked on the base ground terminal 12, any number of the extender ground terminals 14 may be stacked on the base ground terminal 12 to electrically connect any number of electrical components of the vehicle to the common ground point.

The ground point to which the ground terminal assembly 10 is mounted may be located anywhere on the vehicle and may be located on any component of the vehicle, such as, but not limited to, a location on a chassis and/or frame of the vehicle, a location on an electrically conductive structure is mounted on the chassis and/or frame of the vehicle, and/or the like. The electrical components grounded by the ground terminal assembly 10 may be any electrical component of the vehicle, such as, but not limited to, the ignition of a power source of the vehicle (such as, but not limited to, an engine, an electrical motor, and/or the like), hazard lights, a dome light, a radio, running lights, an alarm, a clock, a cigarette lighter plug, power windows and/or doors, fuel injection components, control systems, a memory, and/or like. The vehicle may be any suitable vehicle that includes one or more electrical components that are desired to be grounded to the vehicle, such as, but not limited to, an automobile, an aircraft, a watercraft, and/or the like.

Figure 2:
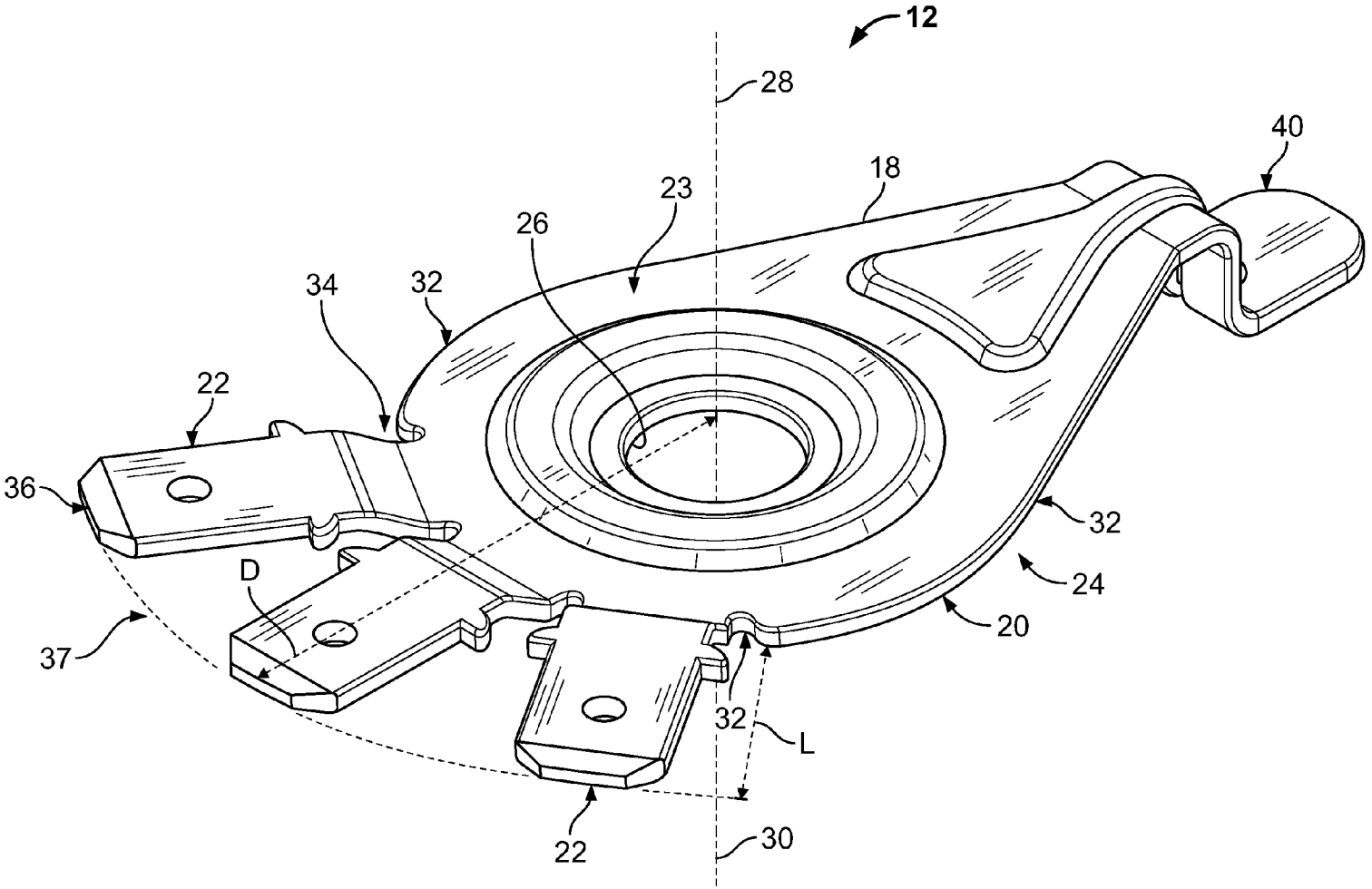
FIG. 2 is perspective view of an exemplary embodiment of a base ground terminal of the ground terminal assembly shown in FIG. 1.

FIG. 2 is perspective view of the base ground terminal 12. The base ground terminal 12 includes a body 18 fabricated from any suitable electrically conductive material(s) that enables the base ground terminal 12 to function as described and/or illustrated herein. The body 18 includes a base hub 20 and a plurality of electrical contacts 22 extending radially outward from the base hub 20. The base hub 20 includes a pair of opposite side portions 23 and 24. The side portion 24 is configured to engage, and thereby electrically connect to, a ground point of the vehicle. The base hub 20 may be referred to herein as a "hub". The electrical contacts 22 may each be referred to herein as a "base electrical contact".

An opening 26 extends through the base hub 20. The opening 26 may be referred to herein as a "base opening". The opening 26 is configured to receive any type of fastener (not shown) for attaching the base hub 20, and thereby the base ground terminal 12, to the ground point of the vehicle. The fastener may be any suitable type of fastener that enables the base ground terminal 12 to be attached to the ground point such that the base ground terminal 12 functions as described and/or illustrated herein, such as, but not limited to, a threaded fastener and/or the like. In the exemplary embodiment, the opening 26 is approximately concentric with the base hub 20. Specifically, a central longitudinal axis 28 of the opening 26 is aligned with a central axis 30 of the base hub 20. However, the opening 26 may have any suitable location on the base hub 20 that enables the opening 26 to function as described and/or illustrated herein. For example, alternatively the central longitudinal axis 28 of the opening 26 is offset from, and/or non-parallel with, the central axis 30. Although the opening 26 is shown in the exemplary embodiment as having a circular shape, the opening 26 may have any other suitable shape, size, geometry and/or the like that enables the opening 26 to function as described and/or illustrated herein. Although one opening 26 is shown, the base hub 20 may include any number of openings 26.

Figure 3:
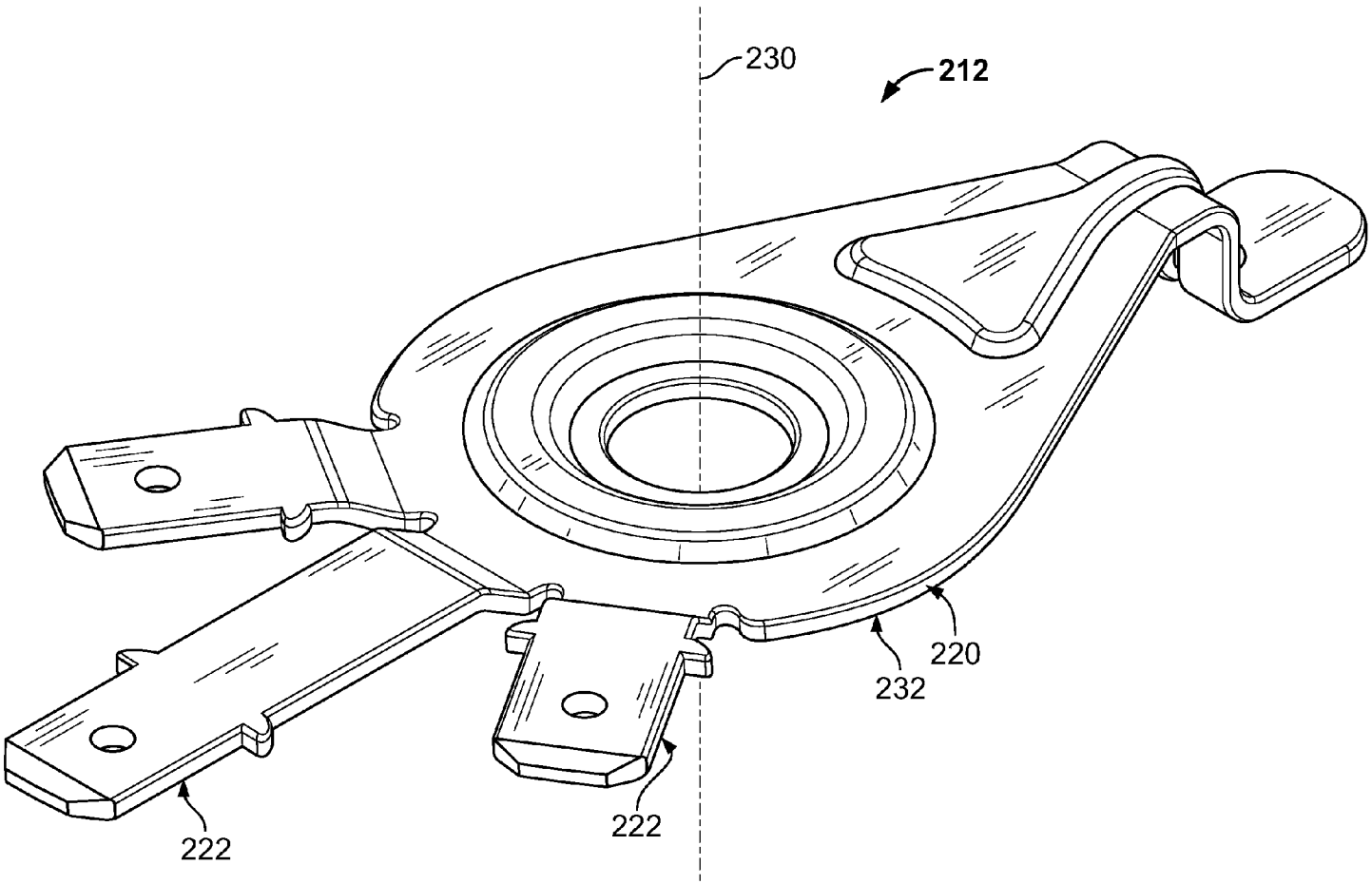
FIG. 3 is a perspective view of an exemplary alternative embodiment of a base ground terminal.

As described above, the electrical contacts 22 extend radially outward from the base hub 20. Specifically, each of the electrical contacts 22 extends outwardly from a circumference 32 of the base hub 20 and extends radially outward relative to the central axis 30 of the base hub 20. Each electrical contact 22 extends between an end portion 34 that is connected to the circumference 32 of the base hub 20 and a free end portion 36. As can be seen in FIG. 2, in the exemplary embodiment the free end portions 36 are arranged in an arcuate pattern 37. In the exemplary embodiment, each of the electrical contacts 22 extends the same length L from the circumference 32 of the base hub 20. In other words, each electrical contact 22 extends the same distance D measured from the central axis 30 to an end surface of the free end portion 36. Alternatively, one or more of the electrical contacts 22 extends a different length L and/or a different distance D than one or more of the other electrical contacts 22. In such an embodiment wherein one or more of the electrical contacts 22 extends a different length L and/or a different distance D than one or more of the other electrical contacts 22, the pattern of the free end portions 36 of the electrical contacts 22 is still considered to be arcuate. FIG. 3 illustrates an exemplary alternative embodiment of a base ground terminal 212 wherein some electrical contacts 222 extend a different length than other electrical contacts 222 from a circumference 232 of a base hub 220 and a different distance than other electrical contacts 222 from a central axis 230 of the base hub 220.

Referring again to FIG. 2, and as will be described below, each electrical contact 22 is configured to engage a corresponding one of the ground wire terminals 16 (FIGS. 1 and 4-8) for electrically connecting the ground wire terminals 16 to the base ground terminal 12. Although three electrical contacts 22 are shown, the base ground terminal 12 may include any number of electrical contacts 22 for engagement with any number of ground wire terminals 16. Moreover, although only a portion of the circumference 32 of the base hub 20 includes electrical contacts 22 extending therefrom, alternatively more of the circumference 32 and/or an approximate entirety of the circumference 32 may include electrical contacts 22 extending therefrom.

In the exemplary embodiment, each electrical contact 22 is an elongate tab that is configured to be received within a receptacle 38 (FIGS. 4-8) of the corresponding ground wire terminal 16 for electrical connection with the ground wire terminal 16. However, the electrical contacts 22 may each by any suitable type of electrical contact and may each include any suitable shape, size, geometry and/or the like that enables the electrical contacts 22 to function as described and/or illustrated herein, such as, but not limited to, an alternative embodiment wherein one or more of the electrical contacts 22 define a receptacle (not shown) that receives a portion (not shown) of the corresponding ground wire terminal 16 therein.

An optional anti-rotation flange 40 may extend outwardly from the base hub 20 to facilitate attaching the base ground terminal 12 to the vehicle. Specifically, the flange 40 is configured to engage a portion of the vehicle adjacent the ground point. For example, the flange 40 may be received within an opening (not shown) and/or slot (not shown) within the vehicle adjacent the ground point.

Figure 4:
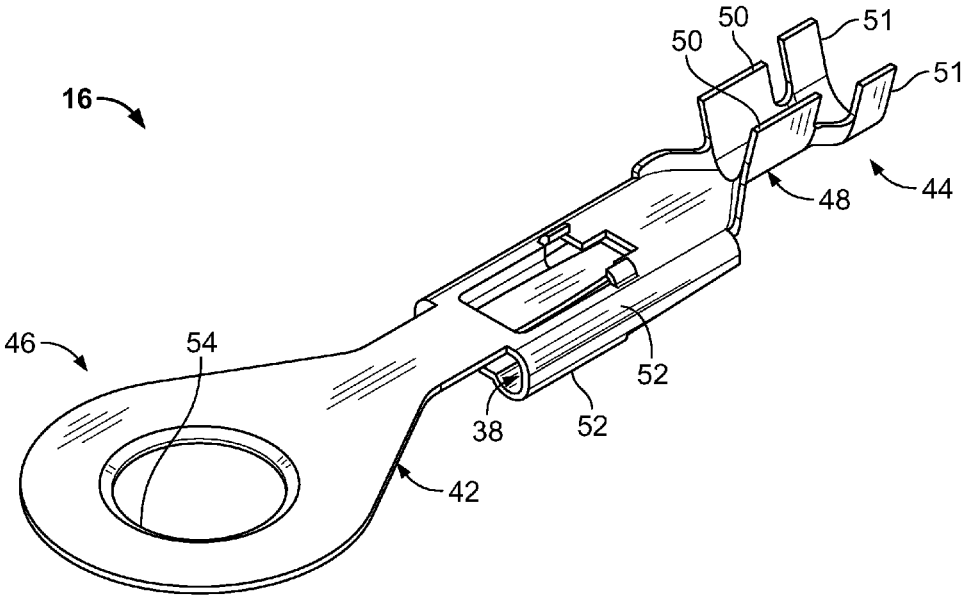
FIGS. 4 and 5 are perspective views of an exemplary embodiment of a ground wire terminal of the ground terminal assembly shown in FIG. 1.
Figure 5:
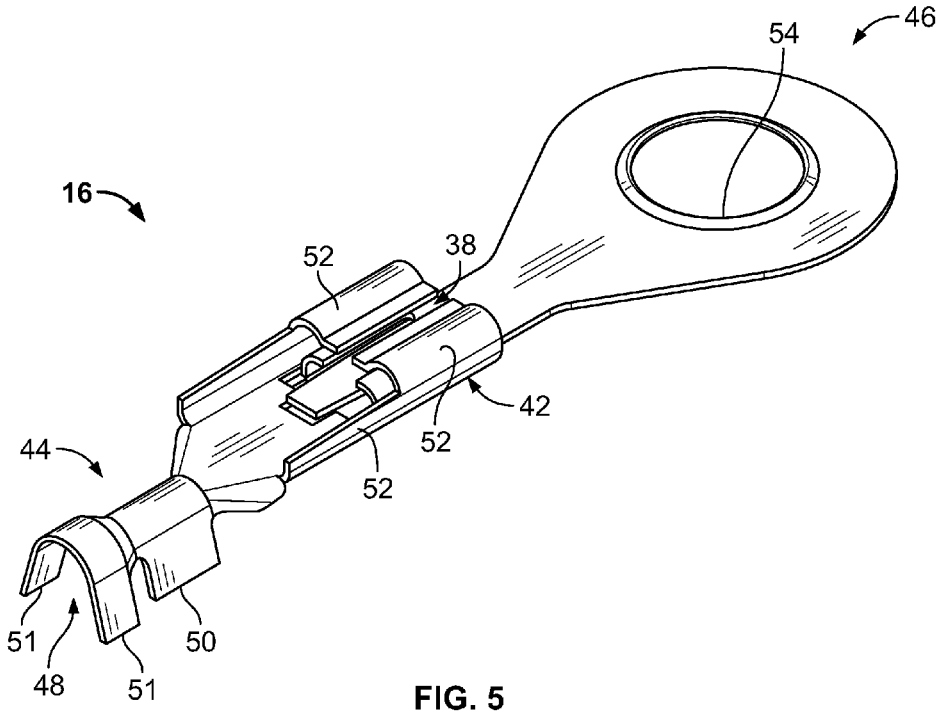

FIGS. 4 and 5 are perspective views of an exemplary embodiment of a ground wire terminal 16. The ground wire terminal 16 may be used with the base ground terminal 12

Figure 8:
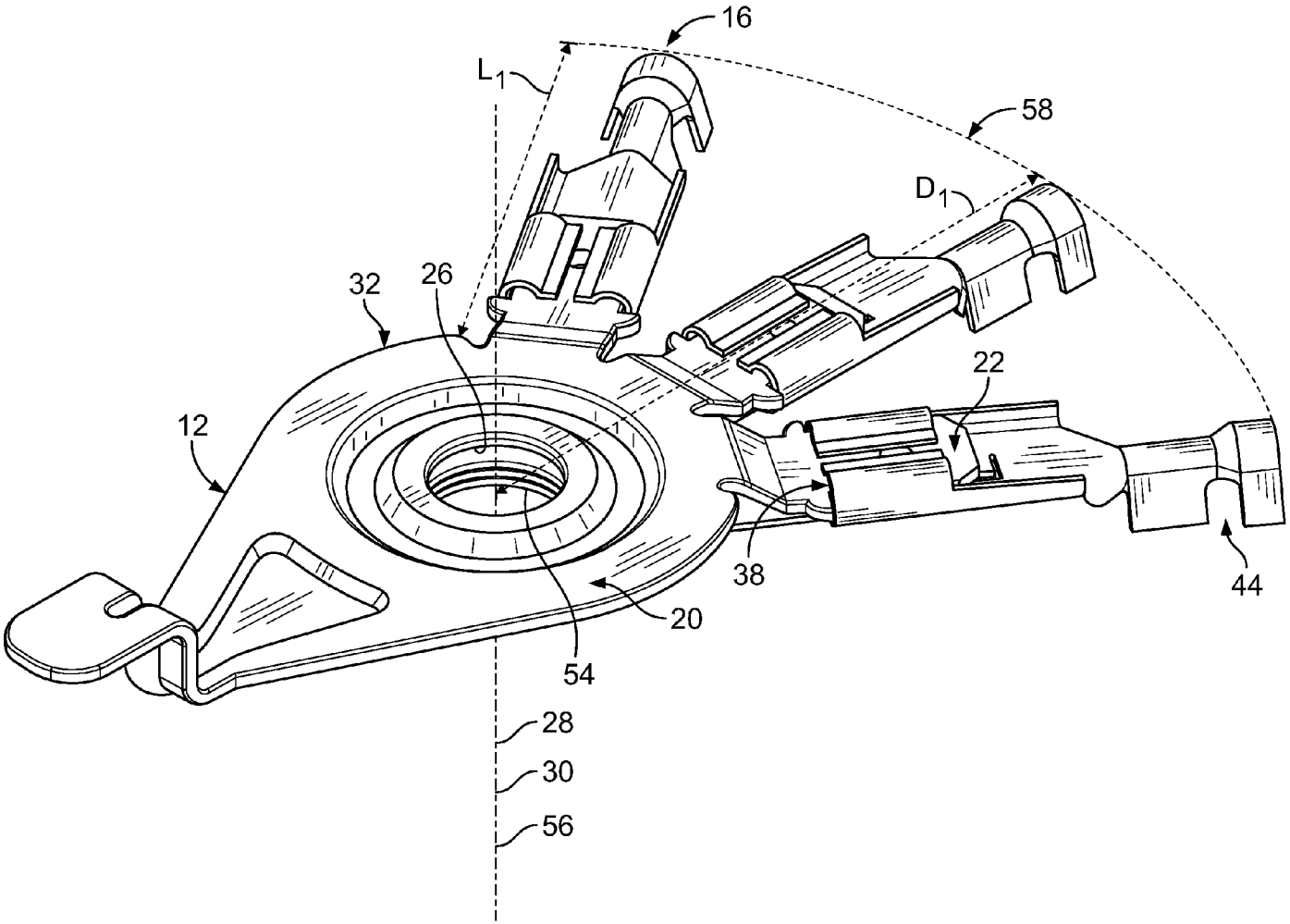
Figure 9:
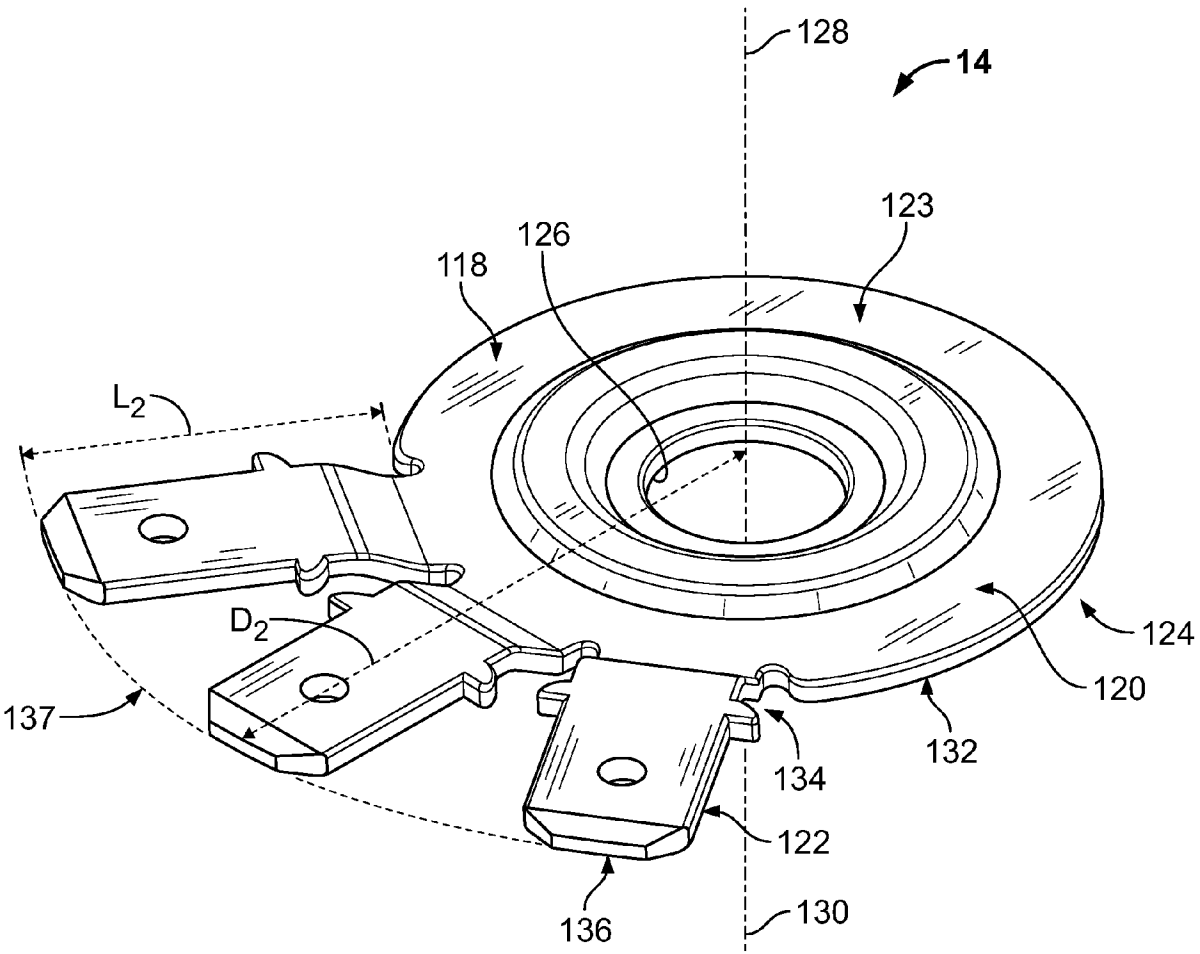
FIG. 9 is a perspective view of an exemplary embodiment of an extender ground terminal of the ground terminal assembly shown in FIG. 1.

(FIGS. 1, 2, and 6-8) and/or the extender ground terminal 14 (FIGS. 1 and 9). The ground wire terminal 16 includes a body 42 extending between a pair of opposite end portions 44 and 46. The end portion 44 includes a wire engagement portion 48 that is configured to engage, and thereby electrically connect to, an electrical wire that is electrically connected to the corresponding electrical component of the vehicle. In the exemplary embodiment, the wire engagement portion 48 includes one or more extensions 50. The extensions 50 are configured to be crimped over, and into engagement with, an exposed portion of the corresponding electrical wire to mechanically hold the electrical wire on the wire engagement portion 48 and electrically connect the electrical wire to the ground wire terminal 16. Alternatively, the wire engagement portion 48 may include any other suitable type of connection with the electrical wire that enables the electrical wire to be mechanically and electrically connected to the wire engagement portion 48. The wire engagement portion 48 may optionally include one or more extensions 51 that are configured to be crimped over, and into engagement with, an insulating jacket (not shown) of the corresponding electrical wire.

As described above, the body 42 of the ground wire terminal 16 includes a receptacle 38 that receives a corresponding one of the electrical contacts 22 (FIGS. 1, 2, and 6-8) of the base ground terminal 12 and/or a corresponding electrical contact 122 (shown in FIG. 9) of the extender ground terminal 14. In the exemplary embodiment, the receptacle 38 is defined by a plurality of walls 52 of the body 42 of the ground wire terminal 16. The receptacle 38 is sized and shaped to receive the corresponding electrical contact 22 and/or 122 therein. In the exemplary embodiment, the receptacle 38 is sized and shaped to receive the corresponding electrical contact 22 and/or 122 in an interference fit, such that the corresponding electrical contact 22 and/or 122 is mechanically and electrically connected to the ground wire terminal 16. However, the receptacle 38 may hold the corresponding electrical contact 22 and/or 122 in any other suitable type of engagement, fit, and/or the like that enables the corresponding electrical contact 22 and/or 122 to mechanically and electrically connect to the ground wire terminal 16.

Although in the exemplary embodiment each electrical contact 22 and/or 122 is configured to be received within the receptacle 38, alternatively the ground wire terminal 16 may include any other suitable shape, size, geometry and/or the like that enables the electrical contacts 22 and/or 122 to function as described and/or illustrated herein, such as, but not limited to, an alternative embodiment wherein one or more of the electrical contacts 22 and/or 122 define a receptacle that receives a portion of the ground wire terminal 16 therein.

The end portion 46 of the body 42 of the ground wire terminal 16 includes an opening 54. The opening 54 may be referred to herein as a "ground wire terminal opening". The opening 54 is configured to receive the fastener to facilitate attaching the ground wire terminal 16 to the base ground terminal 12 and/or to the extender ground terminal 14. Attachment of the end portion 46 of the ground wire terminal 16 to the base ground terminal 12 and/or the extender ground terminal 14, via the opening 54 and the fastener, may also facilitate electrical connection between the ground wire terminal 16 and the base ground terminal 12 and/or between the ground wire terminal 16 and the extender ground terminal 14. Although the opening 54 is shown in the exemplary embodiment as having a circular shape, the opening 54 may have any other suitable shape, size, geometry and/or the like that enables the opening 54 to function as described and/or illustrated herein.

Figure 6:
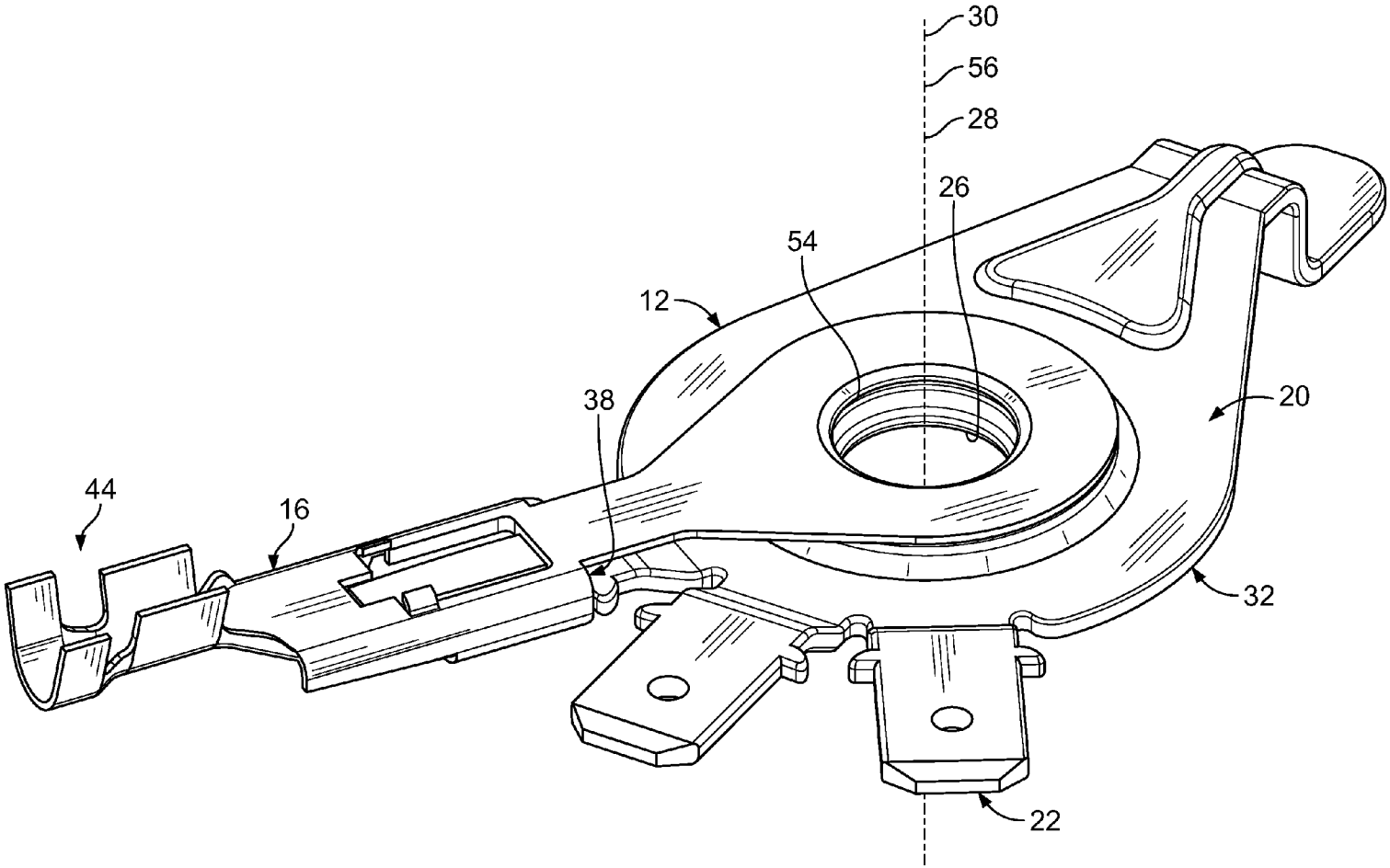
FIGS. 6-8 are perspective views illustrating installation of a plurality of the ground wire terminals shown in FIGS. 4 and 5 on the base ground terminal shown in FIG. 2.
Figure 7:
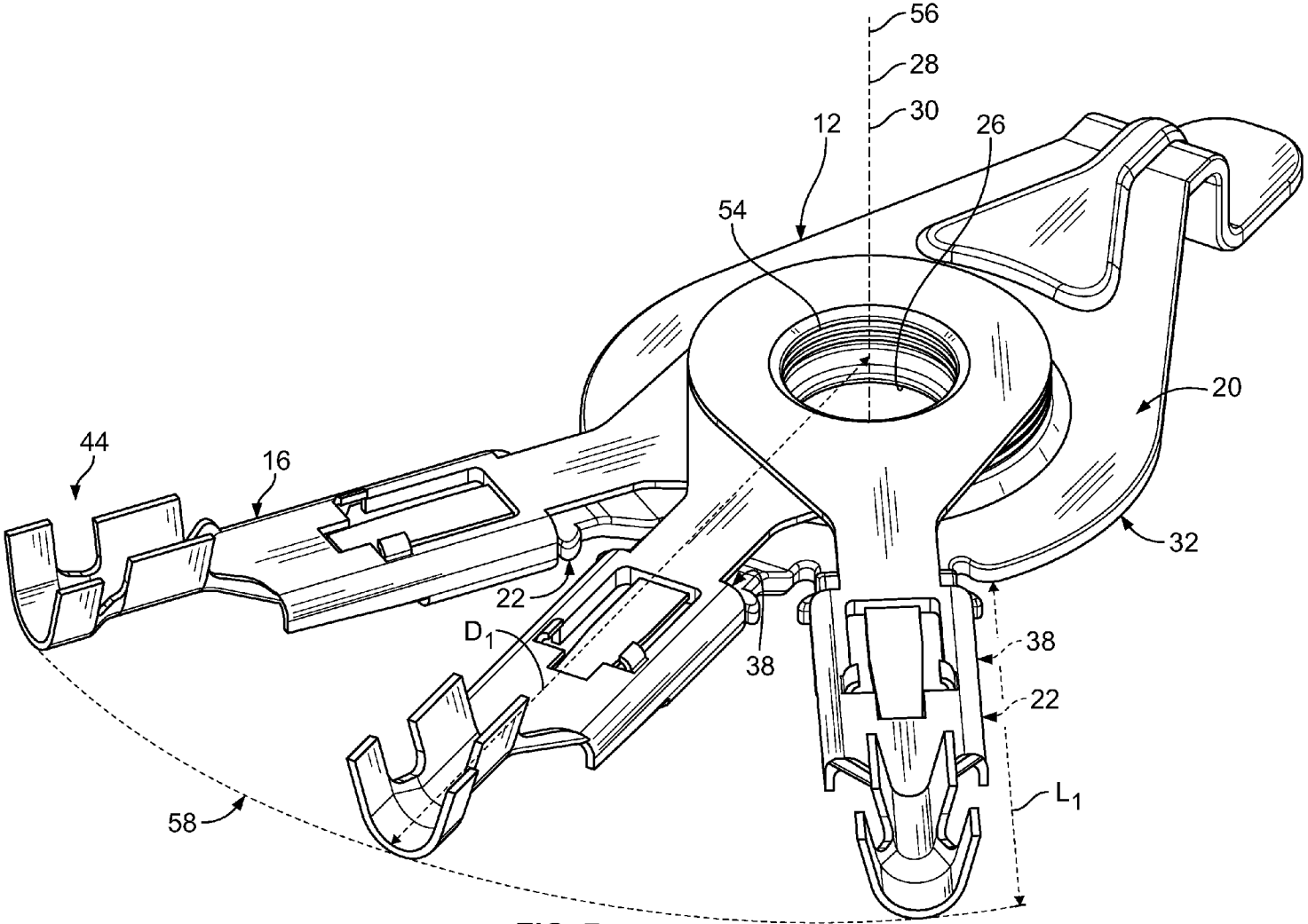

FIGS. 6-8 illustrate installation of a plurality of the ground wire terminals 16 on the base ground terminal 12. Each ground wire terminal 16 is engaged with a corresponding electrical contact 22 of the base ground terminal 12. Specifically, in the exemplary embodiment each electrical contact 22 of the base ground terminal 12 is received within the receptacle 38 of the corresponding ground wire terminal 16. Moreover, the opening 54 of each ground wire terminal 16 is at least partially aligned with the opening 26 of the base ground terminal 12 such that the fastener can be received through the openings 26 and 54. In the exemplary embodiment, the opening 54 of each ground wire terminal 16 is approximately completely aligned with the opening 26 of the base ground terminal 12 such that a central longitudinal axis 56 of the opening 54 is approximately aligned with the central longitudinal axis 28 of the opening 26. Alternatively, the opening 54 of one or more of the ground wire terminals 16 may be only partially aligned with the opening 26 of the base ground terminal 12 such that the openings 26 and 54 communicate with each other but the central longitudinal axes 28 and 56 are offset and/or non-parallel from each other. In some alternative embodiments, the openings 54 of one or more ground wire terminals 16 are at least partially aligned with one or more different openings 26 of the base ground terminal 12 than others of the ground wire terminals 16.

As can be seen in FIGS. 7 and 8, in the exemplary embodiment, when the ground wire terminals 16 are installed on the base ground terminal 12, the end portions 44 of the ground wire terminals 16 are arranged in an arcuate pattern 58. In the exemplary embodiment, each of the ground wire terminals 16 extends the same length $L_1$ from the circumference 32 of the base hub 20. In other words, each ground wire terminal 16 extends the same distance $D_1$ measured from the central axis 30 to an end surface of the end portion 44. Alternatively, one or more of the ground wire terminals 16 extends a different length $L_1$ and/or a different distance $D_1$ than one or more of the other ground wire terminals 16. In such an embodiment wherein one or more of the ground wire terminals 16 extends a different length $L_1$ and/or a different distance $D_1$ than one or more of the other ground wire terminals 16, the pattern of the end portions 44 of the ground wire terminals 16 is still considered to be arcuate.

FIG. 9 is perspective view of the extender ground terminal 14. The extender ground terminal 14 includes a body 118 fabricated from any suitable electrically conductive material(s) that enables the extender ground terminal 14 to function as described and/or illustrated herein. The body 118 includes an extender hub 120 and a plurality of electrical contacts 122 extending radially outward from the extender hub 120. The extender hub 120 includes a pair of opposite side portions 123 and 124. The side portion 124 is configured to engage, and thereby electrically connect to, the side portion 23 (FIGS. 1 and 2) of the base ground terminal 12 (FIGS. 1, 2, and 6-8). The extender hub 120 may be referred to herein as a "hub". The electrical contacts 122 may each be referred to herein as an "extender electrical contact".

An opening 126 extends through the extender hub 120. The opening 126 may be referred to herein as an "extender opening". The opening 126 is configured to receive the fastener for attaching the extender hub 120, and thereby the extender ground terminal 14, to the base ground terminal 12. Thereby, the extender ground terminal 14 is electrically connected to the ground point of the vehicle. In the exemplary embodiment, the opening 126 is approximately concentric with the extender hub 120. Specifically, a central longitudinal axis 128 of the opening 126 is aligned with a central axis 130 of the extender hub 120. However, the opening 126 may have any suitable location on the extender hub 120 that enables the opening 126 to function as described and/or illustrated herein. For example, alternatively the central longitudinal axis 128 of the opening 126 is offset from, and/or non-parallel with, the central axis 130 along the extender hub 120. Although the opening 126 is shown in the exemplary embodiment as having a circular shape, the opening 126 may have any other suitable shape, size, geometry and/or the like that enables the opening 126 to function as described and/or illustrated herein. Although one openings 126 is shown, the extender hub 120 may include any number of openings 126.

The electrical contacts 122 extend radially outward from the extender hub 120. Specifically, each of the electrical contacts 122 extends outwardly from a circumference 132 of the extender hub 120 and extends radially outward relative to the central axis 130 of the extender hub 120. Each electrical contact 122 extends between an end portion 134 that is connected to circumference 132 of the extender hub 120 and a free end portion 136. As can be seen in FIG. 9, in the exemplary embodiment the free end portions 136 are arranged in an arcuate pattern 137. In the exemplary embodiment, each of the electrical contacts 122 extends the same length $L_2$ from the circumference 132 of the extender hub 120. In other words, each electrical contact 122 extends the same distance $D_2$ measured from the central axis 130 to an end surface of the free end portion 134. Alternatively, one or more of the electrical contacts 122 extends a different length $L_2$ and/or a different distance $D_2$ than one or more of the other electrical contacts 122. In such an embodiment wherein one or more of the electrical contacts 122 extends a different length $L_2$ and/or a different distance $D_2$ than one or more of the other electrical contacts 122, the pattern of the free end portions 134 of the electrical contacts 122 is still considered to be arcuate.

Each electrical contact 122 is configured to engage a corresponding one of the ground wire terminals 16 (FIGS. 1 and 4-8) for electrically connecting the ground wire terminals 16 to the extender ground terminal 14. Although three electrical contacts 122 are shown, the extender ground terminal 14 may include any number of electrical contacts 122 for engagement with any number of ground wire terminals 16. Moreover, although only a portion of the circumference 132 of the extender hub 120 includes electrical contacts 122 extending therefrom, alternatively more of the circumference 132 and/or an approximate entirety of the circumference 132 may include electrical contacts 122 extending therefrom.

In the exemplary embodiment, each electrical contact 122 is an elongate tab that is configured to be received within the receptacle 38 (FIGS. 4-8) of the corresponding ground wire terminal 16 for electrical connection with the ground wire terminal 16. However, the electrical contacts 122 may each by any suitable type of electrical contact and may each include any suitable shape, size, geometry and/or the like that enables the electrical contacts 122 to function as described and/or illustrated herein, such as, but not limited to, an alternative embodiment wherein one or more of the electrical contacts 122 define a receptacle (not shown) that receives a portion (not shown) of the ground wire terminal 16 therein.

The manner in which the ground wire terminals 16 are engaged with the electrical contacts 122 is substantially similar to that described above with respect to the electrical contacts 22 (all of the discussion and illustration of the electrical contacts 22 at least with respect to the ground wire terminals 16 is applicable to the electrical contacts 122 and the ground wire terminals 16) and therefore will not be described in more detail herein.

Referring again to FIG. 1, to install the ground terminal assembly 10, the base ground terminal 12 is positioned on the ground point of the vehicle such that the side portion 24 of the base hub 20 is engaged with the ground point. In some embodiments, the base ground terminal 12 is secured to the ground point without the extender ground terminal 14 such that the ground terminal assembly 10 does not include any extender ground terminals 14. In such an embodiment wherein the ground terminal assembly 10 does not include any extender ground terminals 14, the base ground terminal 12 is secured to the ground point of the vehicle by inserting the fastener through the opening 26 (FIGS. 2 and 6-8) and engaging the fastener and with any suitable mounting component (such as, but not limited to, an opening, a threaded opening, and/or the like) of the vehicle that is adjacent the ground point.

To electrically connect more electrical components of the vehicle to the common ground point, one or more extender ground terminals 14 may be stacked on the base ground terminal 12. The extender ground terminal 14 is stacked on the base ground terminal 12 such that the side portion 124 of the extender ground terminal 14 is engaged with the side portion 23 of the base ground terminal 12 and such that the opening 126 of the extender ground terminal 14 is at least partially aligned with the opening 26 of the base ground terminal 12. In the exemplary embodiment, the opening 126 is approximately completely aligned with the opening 26 such that the central longitudinal axis 28 of the opening 26 is approximately aligned with the central longitudinal axis 128 of the opening 126. Alternatively, the opening 126 may be only partially aligned with the opening 26 such that the openings 26 and 126 communicate with each other but the central longitudinal axes 28 and 128 are offset from, and/or non-parallel with, each other. The ground terminal assembly 10 is secured to the ground point of the vehicle by inserting the fastener through the openings 26, 54, and 126 and engaging the fastener and with the mounting component of the vehicle that is adjacent the ground point.

In the exemplary embodiment, and as shown in FIG. 1, only one extender ground terminal 14 is stacked on the base ground terminal 12. However, any number of extender ground terminals 14 may be stacked on the base ground terminal 12 to electrically connect any number of electrical components of the vehicle to a common ground point.

In an alternative embodiment, the base ground terminal 12, the extender ground terminal 14, and/or the ground terminal assembly 10 overall may not include the ground wire terminals 16, but rather one or more of the electrical contacts 22 and/or 122 may directly electrically and mechanically connect to the corresponding electrical wires.

Figure 10:
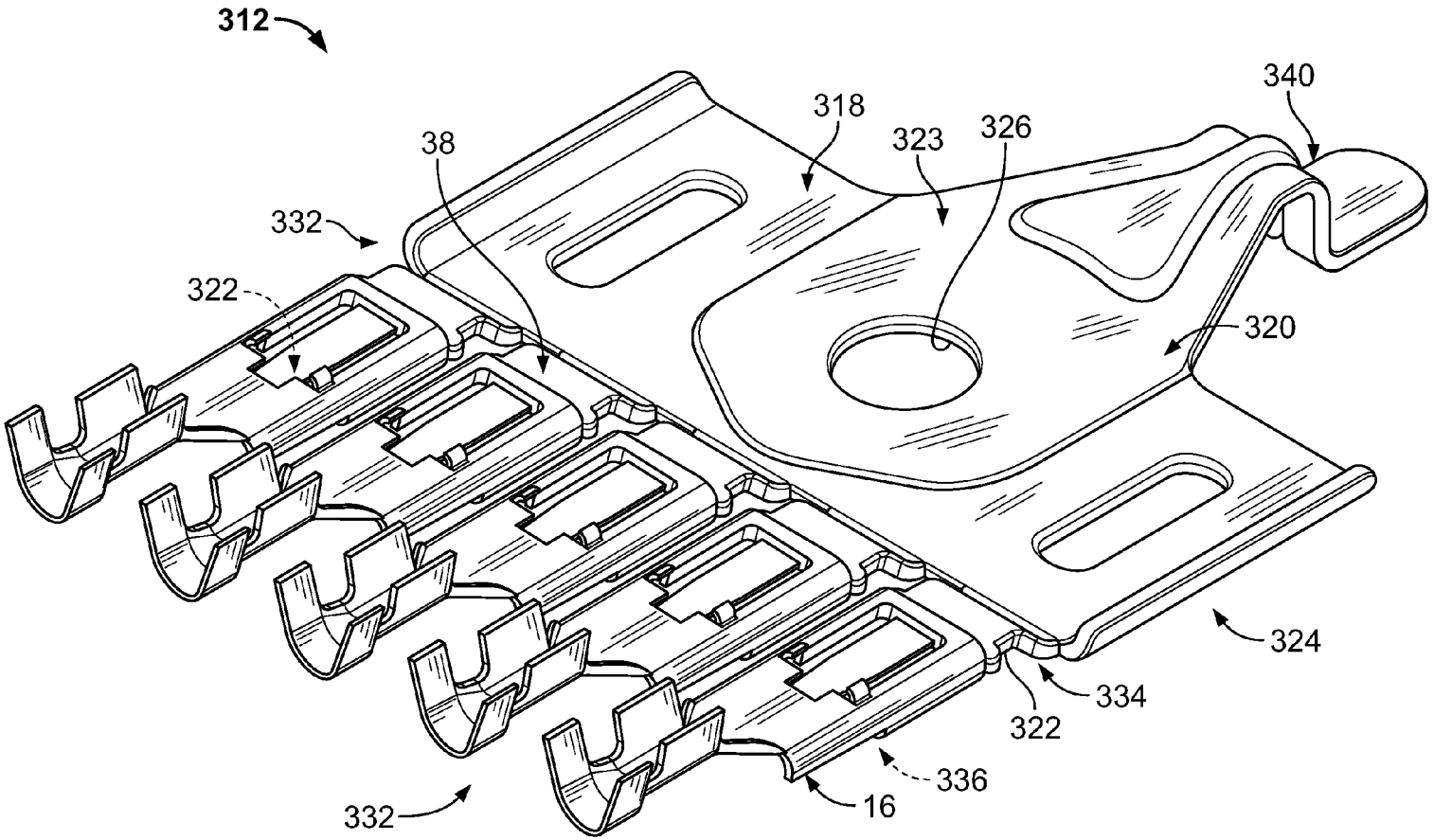
FIG. 10 is a perspective view of an exemplary alternative embodiment of a base ground terminal having a plurality of the ground wire terminals shown in FIGS. 4 and 5 connected thereto.

FIG. 10 is a perspective view of an exemplary alternative embodiment of a base ground terminal 312 having a plurality of the ground wire terminals 16 connected thereto. The base ground terminal 312 includes a body 318 fabricated from any suitable electrically conductive material(s) that enables the base ground terminal 312 to function as described and/or illustrated herein. The body 318 includes a base hub 320 and a plurality of electrical contacts 322 extending outwardly from the base hub 320. The base hub 320 includes a pair of opposite side portions 323 and 324. The side portion 324 is configured to engage, and thereby electrically connect to, a ground point of the vehicle. The base hub 320 may be referred to herein as a "hub". The electrical contacts 322 may each be referred to herein as a "base electrical contact".

An opening 326 extends through the base hub 320. The opening 326 may be referred to herein as a "base opening". The opening 326 is configured to receive the fastener for attaching the base hub 320, and thereby the base ground terminal 312, to the ground point of the vehicle. In the exemplary embodiment, the base hub 320 also includes a plurality of optional openings 321 that are configured to receive a fastener for attaching the base hub 320, and thereby the base ground terminal 312, to the ground point of the vehicle. The openings 321 may each be referred to herein as a "base opening". The fastener may be any suitable type of fastener that enables the base ground terminal 312 to be attached to the ground point such that the base ground terminal 312 functions as described and/or illustrated herein, such as, but not limited to, a threaded fastener and/or the like. The openings 321 and 326 may each have any suitable location on the base hub 320 that enables each of the openings 321 and 326 to function as described and/or illustrated herein. Although the opening 326 is shown in the exemplary embodiment as having a circular shape, and the openings 321 are shown in the exemplary embodiment has having an elongate shape, the openings 321 and 326 may each have any other suitable shape, size, geometry and/or the like that enables the opening 326 to function as described and/or illustrated herein. Although two openings 321 are shown and one openings 326 is shown, the base hub 320 may include any number of openings 321 and any number of openings 326.

As described above, the electrical contacts 322 extend outwardly from the base hub 320. Specifically, each of the electrical contacts 322 extends outwardly from a common side portion 332 of the base hub 320. Each electrical contact 322 extends between an end portion 334 that is connected to side portion 332 of the base hub 320 and a free end portion 336. As should be evident from FIG. 10, in the exemplary embodiment the free end portions 336 are arranged in a linear pattern. In the exemplary embodiment, each of the electrical contacts 322 extends the same length from the side portion 332 of the base hub 320. Alternatively, one or more of the electrical contacts 322 extends a different length from the side portion 332 than one or more of the other electrical contacts 322.

Each electrical contact 322 engages a corresponding one of the ground wire terminals 16 for electrically connecting the ground wire terminals 16 to the base ground terminal 312. Although five electrical contacts 322 are shown, the base ground terminal 312 may include any number of electrical contacts 322 for engagement with any number of ground wire terminals 16. Moreover, although only one side portion 332 of the base hub 320 includes electrical contacts 322 extending therefrom, alternatively one or more other side portions of the base hub 320 may include electrical contacts 322 extending therefrom.

In the exemplary embodiment, each electrical contact 322 is an elongate tab that is configured to be received within the receptacle 38 of the corresponding ground wire terminal 16 for electrical connection with the ground wire terminal 16. However, the electrical contacts 322 may each by any suitable type of electrical contact and may each include any suitable shape, size, geometry and/or the like that enables the electrical contacts 322 to function as described and/or illustrated herein, such as, but not limited to, an alternative embodiment wherein one or more of the electrical contacts 322 define a receptacle (not shown) that receives a portion (not shown) of the corresponding ground wire terminal 16 therein.

An optional flange 340 may extend outwardly from the base hub 320 to facilitate attaching the base ground terminal 312 to the vehicle. Specifically, the flange 340 is configured to engage a portion of the vehicle adjacent the ground point. For example, the flange 340 may be received within an opening (not shown) and/or slot (not shown) within the vehicle adjacent the ground point.

To electrically connect more electrical components of the vehicle to the common ground point, one or more extender ground terminals may be stacked on the base ground terminal 312. For example, one or more extender ground terminals that have a similar shape to the base ground terminal 312, and/or one or more of the extender ground terminals 14 (FIGS. 1 and 9), may be stacked on the base ground terminal 312.

The embodiments described and/or illustrated herein provide a ground terminal and/or ground terminal assembly for a vehicle that is capable of grounding an increased number of electrical components to a common ground point of the vehicle as compared with at least some known ground terminals and/or ground terminal assemblies.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A ground terminal for a vehicle, said ground terminal comprising:

a hub comprising a hub opening extending therethrough, the hub opening being configured to receive a fastener for attaching the hub to the vehicle;

a plurality of electrical contacts extending radially outward from the hub, each electrical contact extending outwardly from the hub to a free end portion, the free end portions of the electrical contacts being arranged in an arcuate pattern; and a ground wire terminal engaged with an electrical contact of the plurality of electrical contacts, the ground wire terminal comprising a ground wire terminal opening extending therethrough, wherein the ground wire terminal is engaged with the electrical contact such that the ground wire terminal opening is at least partially aligned with the hub opening and configured to receive the fastener for attaching the ground wire terminal to the hub.

2. The ground terminal according to claim 1, wherein at least one of the electrical contacts comprises a tab configured to be received within a receptacle of the ground wire terminal for electrical connection to the ground wire terminal.

3. The ground terminal according to claim 1, wherein the hub comprises a central axis, the electrical contacts extending radially outward relative to the central axis.

4. The ground terminal according to claim 1, wherein the hub comprises a central axis, the free end portions of each of the electrical contacts extending radially outward from the hub approximately the same distance from the central axis as each other.

5. The ground terminal according to claim 1, wherein the hub comprises a central axis, the free end portion of at least one of the electrical contacts extending radially outward from the hub a different distance from the central axis than at least one other electrical contact.

6. The ground terminal according to claim 1, further comprising a flange extending outwardly from the hub, the flange being configured to engage a portion of the vehicle for attaching the hub to the vehicle.

7. The ground terminal according to claim 1, wherein the ground wire terminal opening is entirely peripherally surrounded by the ground wire terminal.

8. The ground terminal according to claim 1, further comprising a plurality of ground wire terminals engaged with corresponding electrical contacts of the plurality of electrical contacts, wherein end portions of the plurality of ground wire terminals extend radially outward from the hub in an arcuate pattern.

9. The ground terminal according to claim 1, wherein the hub is a base hub, the hub opening is a base opening, and the electrical contacts are base electrical contacts, the ground terminal further comprising an extender hub comprising an extender opening extending therethrough, the extender opening being configured to receive the fastener for attaching the extender hub to the vehicle, the extender hub comprising a plurality of extender electrical contacts extending radially outward from the extender hub, wherein the extender hub is configured to be stacked on the base hub such that the extender opening is at least partially aligned with the base opening.

10. The ground terminal according to claim 9, further comprising a second ground wire terminal engaged with one of the extender electrical contacts, wherein the extender hub and the second ground wire terminal are configured to be stacked on the base hub and the ground wire terminal such that the extender opening and both of the ground wire terminal openings are aligned with the base opening for receiving the fastener.

11. A ground terminal assembly for a vehicle, said ground terminal assembly comprising:

a base hub comprising:

a base opening extending therethrough, the base opening being configured to receive a fastener for attaching the base hub to the vehicle; and a plurality of base electrical contacts extending radially outward from the base hub;

an extender hub comprising:

an extender opening extending therethrough, the extender opening being configured to receive the fastener for attaching the extender hub to the vehicle; and a plurality of extender electrical contacts extending radially outward from the extender hub, wherein the extender hub is configured to be stacked on the base hub such that the extender opening is at least partially aligned with the base opening; and a ground wire terminal engaged with one of the base electrical contacts or one of the extender electrical contacts, the ground wire terminal comprising:

a ground wire terminal opening extending therethrough, wherein the ground wire terminal is engaged with the base electrical contact or the extender electrical contact such that the ground wire terminal opening is at least partially aligned with the base opening or the extender opening and configured to receive the fastener for attaching the ground wire terminal to the base hub or the extender hub.

12. The ground terminal assembly according to claim 11, wherein each base electrical contact extends outwardly from the base hub to a free end portion, the free end portions of the base electrical contacts being arranged in an arcuate pattern.

13. The ground terminal assembly according to claim 11, wherein the base hub comprises a central axis, the free end portions of each of the base electrical contacts extending radially outward from the base hub approximately the same distance from the central axis as each other.

14. The ground terminal assembly according to claim 11, wherein each extender electrical contact extends outwardly from the extender hub to a free end portion, the free end portions of the extender electrical contacts being arranged in an arcuate pattern.

15. The ground terminal assembly according to claim 11, wherein the extender hub comprises a central axis, the free end portions of each of the extender electrical contacts extending radially outward from the extender hub approximately the same distance from the central axis as each other.

16. The ground terminal assembly according to claim 11, wherein at least one base electrical contact and/or at least one extender electrical contact comprises a tab configured to be received within a receptacle of the ground wire terminal for electrical connection to the ground wire terminal.

17. The ground terminal assembly according to claim 11, wherein the base hub comprises a central axis, the base electrical contacts extending radially outward relative to the central axis.

18. The ground terminal assembly according to claim 11, wherein the ground wire terminal comprises a wire engagement portion configured to be electrically connected to a ground wire.

19. The ground terminal assembly according to claim 11, further comprising a flange extending outwardly from the base hub, the flange being configured to engage a portion of the vehicle for attaching the base hub to the vehicle.

* * * * *